US009537215B2

(12) United States Patent
Lu

(10) Patent No.: US 9,537,215 B2
(45) Date of Patent: Jan. 3, 2017

(54) ANTENNA STRUCTURE AND WIRELESS COMMUNICATION DEVICE EMPLOYING SAME

(71) Applicant: Chiun Mai Communication Systems, Inc., New Taipei (TW)

(72) Inventor: Chun-Yu Lu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 219 days.

(21) Appl. No.: 14/333,763

(22) Filed: Jul. 17, 2014

(65) Prior Publication Data

US 2015/0022420 A1 Jan. 22, 2015

(30) Foreign Application Priority Data

Jul. 19, 2013 (TW) ..... 102125839 A

(51) Int. Cl.
*H01Q 3/34* (2006.01)
*H01Q 21/29* (2006.01)
*H01Q 9/42* (2006.01)

(52) U.S. Cl.
CPC ..... *H01Q 3/34* (2013.01); *H01Q 21/29* (2013.01); *H01Q 9/42* (2013.01)

(58) Field of Classification Search
CPC ..... H01Q 3/34; H01Q 21/29; H01Q 9/42; H01Q 3/26
See application file for complete search history.

(56) References Cited

U.S. PATENT DOCUMENTS 7,423,607 B2 * 9/2008 Mohamadi ..... H01L 23/66 342/371
8,009,102 B2 * 8/2011 Kim ..... H01Q 1/243 343/700 MS
8,185,162 B2 * 5/2012 Haskell ..... H01Q 1/246 342/423
2007/0194929 A1 * 8/2007 Wagner ..... G06K 7/10346 340/572.7
2011/0032159 A1 * 2/2011 Wu ..... H01Q 21/08 343/702
2011/0195661 A1 * 8/2011 Miyashita ..... H01Q 1/242 455/39
2012/0319919 A1 * 12/2012 Kirovski ..... H01Q 1/243 343/853

* cited by examiner

*Primary Examiner* — Trinh Dinh
(74) *Attorney, Agent, or Firm* — Zhigang Ma

(57) ABSTRACT

An antenna structure includes a first antenna, a second antenna, a radio frequency ("RF") circuit, and a controller. The first antenna includes a first radiating portion and a first feeding portion. The second antenna includes a second radiating portion and a second feeding portion. The second radiating portion is positioned in a first plane that is substantially parallel to a second plane in which the first radiating portion is positioned. The RF circuit is configured to output a first current signal to the first feeding portion and a second current signal to the second feeding portion. The controller is configured to control the RF circuit to adjust phases of the first current signal and the second current signal.

18 Claims, 7 Drawing Sheets

ANTENNA STRUCTURE AND WIRELESS COMMUNICATION DEVICE EMPLOYING SAME

FIELD

The subject matter herein generally relates to antenna structures and wireless communication device employing same.

BACKGROUND

With improvements in the integration of wireless communication systems, antennas have become increasingly important. For a wireless communication device to utilize various frequency bandwidths, antennas having exceptional transmission efficiency have become a significant technology.

BRIEF DESCRIPTION OF THE DRAWINGS

Implementations of the present technology will now be described, by way of example only, with reference to the attached figures.

DETAILED DESCRIPTION

Figure 1:
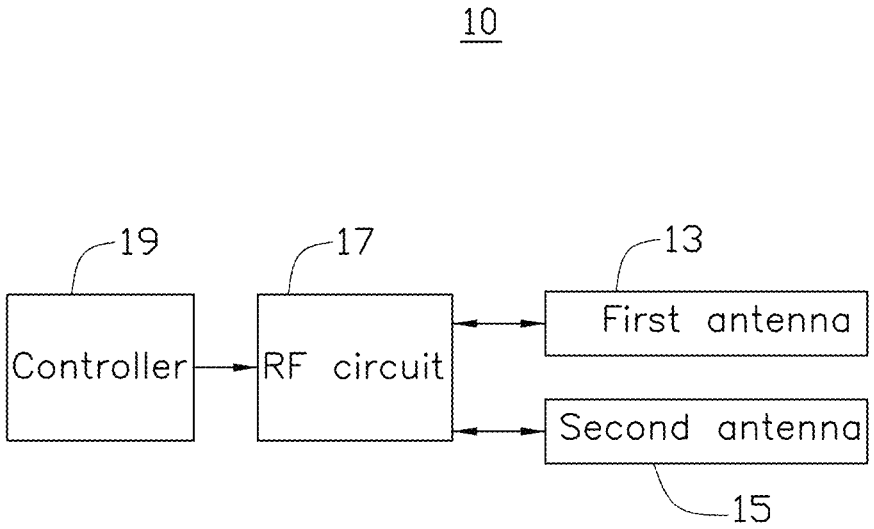
FIG. 1 is a block diagram of one embodiment of an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" when utilized, means "including, but not necessarily limited to"; it specifically indicates open-ended inclusion or membership in the so-described combination, group, series and the like.

FIG. 1 illustrates a block diagram of one embodiment of an antenna structure 10 which can be used in a wireless communication device, such as a mobile phone, a tablet computer. The antenna structure 10 includes a first antenna 13, a second antenna 15, a radio frequency ("RF") circuit 17, and a controller 19.

Figure 2:
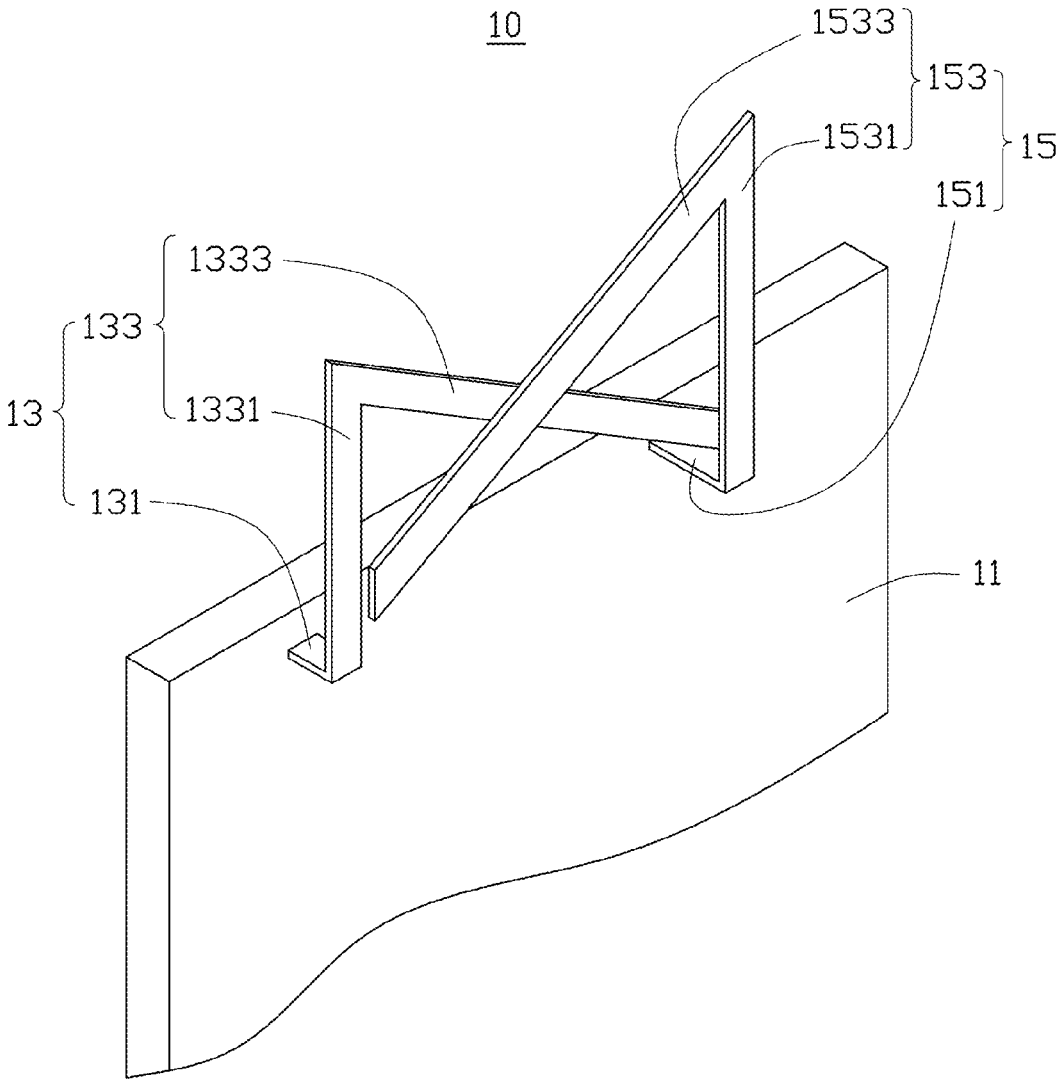
FIG. 2 is an isometric view of the antenna structure of FIG. 1.

FIG. 2 illustrates an isometric view of the antenna structure of FIG. 1. The first antenna 13 includes a first feeding portion 131 and a first radiating portion 133. The second antenna 15 includes a second feeding portion 151 and a second radiating portion 153, the second radiating portion 153 is positioned in a first plane that is substantially parallel to a second plane in which the first radiating portion 133 is positioned; and the second radiating portion 153 is positioned across the first radiating portion 133. The RF circuit 17 (see FIG. 1) is couple to the first feeding portion 131 and the second feeding portion 133. The RF circuit 17 is configured to output a first current signal to the first feeding portion 131 and a second current signal to the second feeding portion 133. The controller 19 is electronically coupled to the RF circuit 17, the controller 19 (see FIG. 1) is configured to control the RF circuit 17 to adjust phases of the first current signal and the second current signal, thereby adjusting a polarization of the antenna structure 10.

In one embodiment, the first antenna 13 and the second antenna 15 are monopole antennas.

In particular, the first radiating portion 133 includes a first radiating arm 1331 and a second radiating arm 1333 that is connected to and coplanar with the first radiating arm 1331. The first radiating arm 1331 substantially perpendicularly extends from the first feeding portion 131; the first feeding portion 131 is positioned in a plane that is substantially perpendicular to the second plane in which the first radiating portion 133 is positioned.

In one embodiment, an acute angle is formed between the first radiating arm 1331 and the second radiating arm 1333. For example, the acute angle formed between the first radiating arm 1331 and the second radiating arm 1333 can be 45 degrees.

The second radiating portion 153 comprises a third radiating arm 1531 and a fourth radiating arm 1533 that is connected to and coplanar with the third radiating arm 1531. The third radiating arm 1531 substantially perpendicularly extends from the second feeding portion 151. The second feeding portion 151 is positioned in a plane that is substantially perpendicular to the first plane in which the second radiating portion 153 is positioned.

In one embodiment, an acute angle is formed between the third radiating arm 1531 and the fourth radiating arm 1533. The fourth radiating arm 1533 is transversely across the second radiating arm 1333. For example, the acute angle formed between the third radiating arm 1531 and the fourth radiating arm 1533 can be 45 degrees.

The antenna structure 10 further includes a printed circuit board ("PCB") 11. The RF circuit 17 and the controller 19 are positioned on the PCB 11, the first feeding portion 131 and the second feeding portion 151 are substantially perpendicularly mounted on the PCB 11. The second feeding portion 151 is longer than the first feeding portion 131, such that the first radiating portion 133 is positioned between and spaced from the PCB 11 and the second radiating portion 153.

In use, since the second radiating portion 153 is positioned across the first radiating portion 133, the second radiating portion 153 can resonate with the first radiating portion 133, such that the antenna structure 10 have a radiation field and a polarization different from that of a general monopole antennas. In addition, the controller 19 can control the RF circuit 17 to adjust the phases of the first current signal and the second current signal, such that the polarization of electromagnetic wave of the antenna structure 10 can be adjusted.

Figure 3:
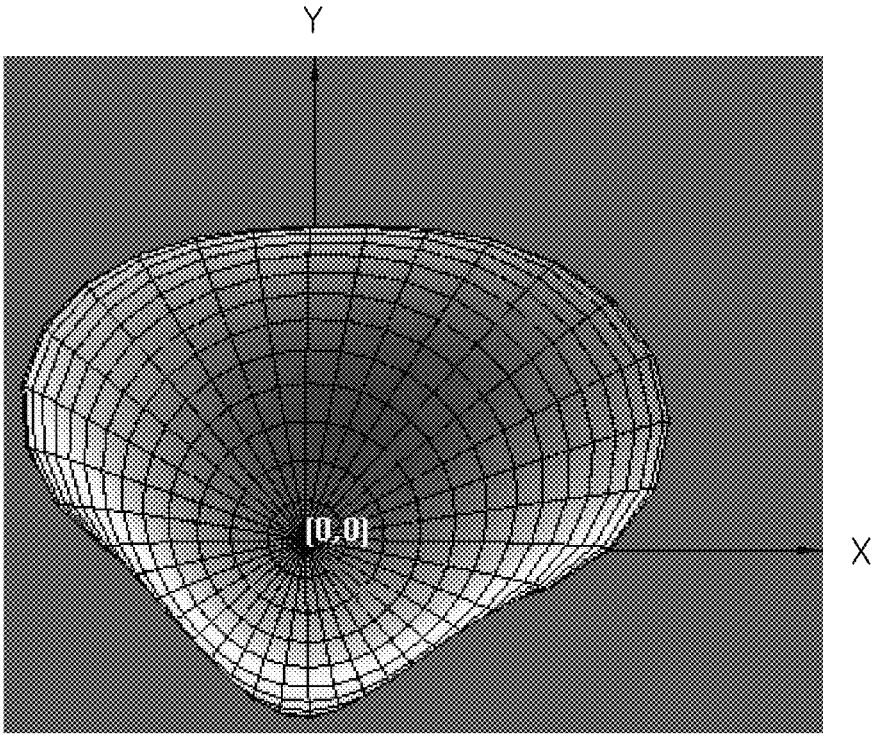
FIGS. 3-6 are diagrams showing polarization measurements of the antenna structure of FIG. 1.
Figure 4:
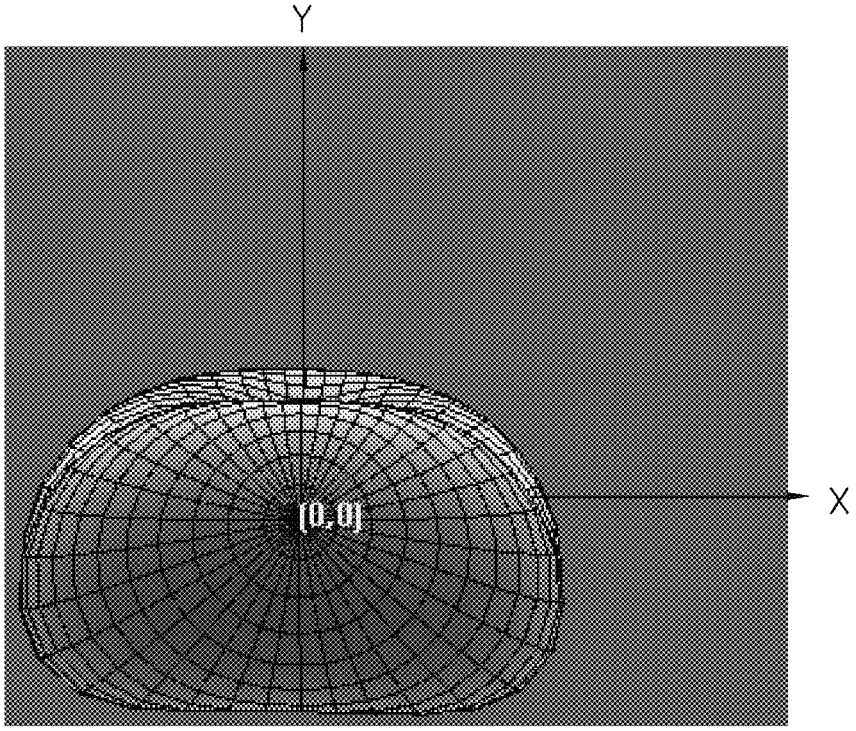
Figure 5:
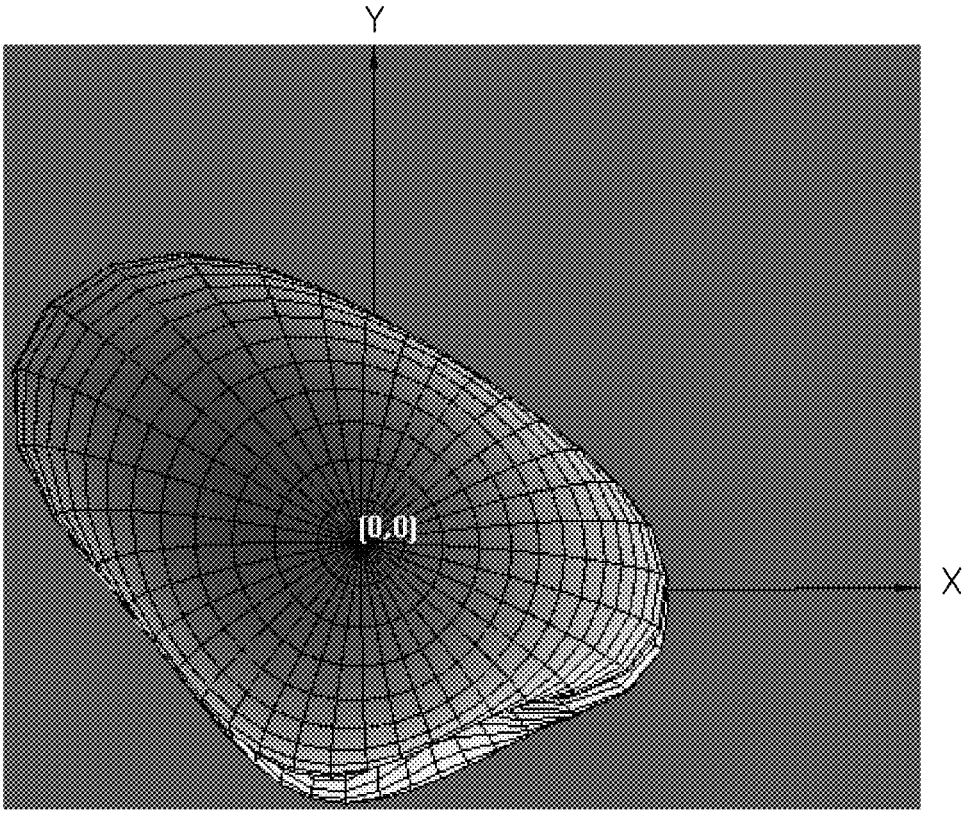
Figure 6:
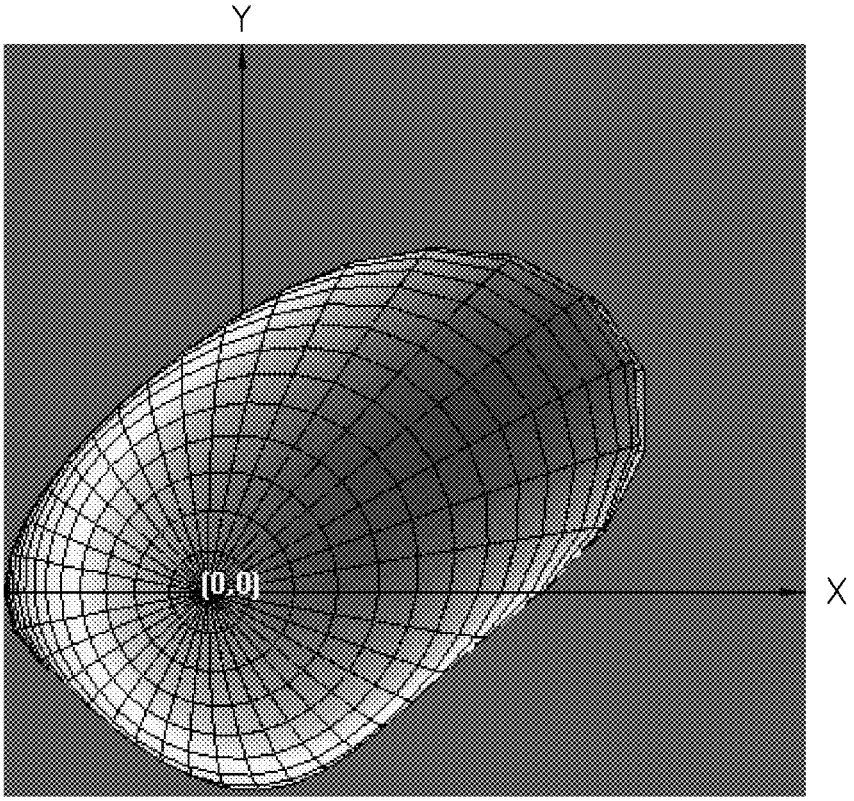

FIGS. 3-6 are diagrams showing polarization measurements of the antenna structure of FIG. 1. When the controller 19 controls the RF circuit 17 to output the first current and second current signal with 180 degrees phase difference, the antenna structure 10 can achieve a vertical polarization as shown in FIG. 3. When the controller 19 controls the RF circuit 17 to output the first current and second current signal with no phase difference, the antenna structure 10 can achieve a horizontal polarization as shown in FIG. 4. When the controller 19 controls the RF circuit 17 to output the first current and second current signal with 135 degrees phase difference, the antenna structure 10 can achieve a negative 45 degrees polarization as shown in FIG. 5. When the controller 19 controls the RF circuit 17 to output the first current and second current signal with 225 degrees phase difference, the antenna structure 10 can achieve a positive 45 degrees polarization as shown in FIG. 6. As a result, polarization direction of the antenna structure 10 can be controlled by the controller 19, such that the antenna structure 10 can receive electromagnetic waves with different polarization directions.

Figure 7:
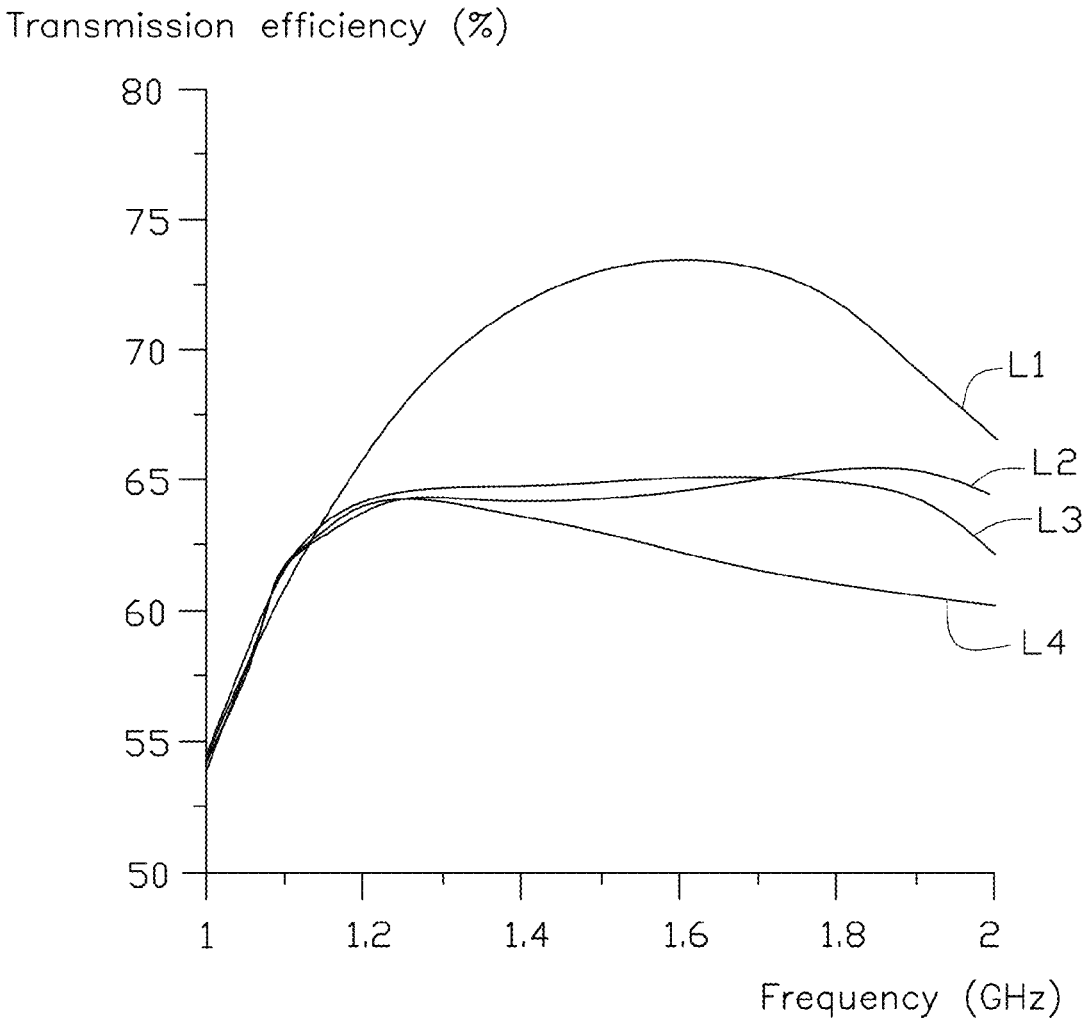
FIG. 7 is a diagram showing transmission efficiency measurements with respect to different polarizations of the antenna structure of FIG. 1.

FIG. 7 is a diagram showing transmission efficiency measurements with respect to different polarizations of the antenna structure 10 of FIG. 1. Curve L1 represents a transmission efficiency of the antenna structure 10 when the antenna structure 10 is vertically polarized. Curve L2 represents the transmission efficiency of the antenna structure 10 when the antenna structure 10 is horizontally polarized. Curve L3 represents the transmission efficiency of the antenna structure 10 when the antenna structure 10 is negative 45-degree polarized. Curve L4 represents the transmission efficiency of the antenna structure 10 when the antenna structure 10 is positive 45-degree polarized. It can be derived from FIG. 7 that the transmission efficiencies of the antenna structure 10 are greater than 60% when the antenna structure 10 is polarized along different directions.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a printed circuit board;

a first antenna, the first antenna comprising a first radiating portion and a first feeding portion;

a second antenna, the second antenna comprising a second radiating portion and a second feeding portion, the second radiating portion positioned in a first plane that is substantially parallel to a second plane in which the first radiating portion is positioned, and the second radiating portion positioned across the first radiating portion;

a radio frequency ("RF") circuit, the RF circuit positioned on the printed circuit board and electronically coupled to the first feeding portion and the second feeding portion, the RF circuit configured to output a first current signal to the first feeding portion and a second current signal to the second feeding portion; and a controller, the controller positioned on the printed circuit board and electronically coupled to the RF circuit, wherein the controller is configured to control the RF circuit to adjust phases of the first current signal and the second current signal;

wherein the second feeding portion is longer than the first feeding portion, the first radiating portion is positioned between and spaced from the printed circuit board and the second radiating portion.

2. The antenna structure of claim 1, wherein the first radiating portion comprises a first radiating arm and a second radiating arm connected to and coplanar with the first radiating arm; wherein the first radiating arm extends in a direction substantially perpendicular to the first feeding portion; and the first feeding portion is positioned in a plane that is substantially perpendicular to the second plane.

3. The antenna structure of claim 2, wherein an acute angle is formed between the first radiating arm and the second radiating arm.

4. The antenna structure of claim 2, wherein the second radiating portion comprises a third radiating arm and a fourth radiating arm connected to and coplanar with the third radiating arm; wherein the third radiating arm extends in a direction substantially perpendicular to the second feeding portion, and the second feeding portion is positioned in a plane that is substantially perpendicular to the first plane.

5. The antenna structure of claim 4, wherein an acute angle is formed between the third radiating arm and the fourth radiating arm.

6. The antenna structure of claim 4, wherein the second radiating arm is transversely across the fourth radiating arm.

7. The antenna structure of claim 1, wherein the first antenna and the second antenna are monopole antennas.

8. The antenna structure of claim 1, wherein the first feeding portion and the second feeding portion are substantially perpendicularly mounted on the printed circuit board.

9. A wireless communication device comprising:

a printed circuit board;

a first antenna, the first antenna comprising a first feeding portion and a first radiating portion;

a second antenna, the second antenna comprising a second feeding portion and a second radiating portion that is positioned parallel to the first radiating portion;

a radio frequency (RF) circuit, the RF circuit mounted on the printed circuit board, and electronically coupled to the first feeding portion and the second feeding portion, the RF circuit configured to output a first current signal to the first feeding portion and a second current signal to the second feeding portion; and a controller, the controller mounted on the printed circuit board and electronically coupled to the RF circuit, wherein the controller is configured to control the RF circuit to adjust phases of the first current signal and the second current signal;

wherein the second feeding portion is longer than the first feeding portion, the first radiating portion is positioned between and spaced from the printed circuit board and the second radiating portion.

10. The wireless communication device of claim 9, wherein the first radiating portion comprises a first radiating arm and a second radiating arm connected to and coplanar with the first radiating arm; and the first radiating arm extends in a direction substantially perpendicular to the first feeding portion.

11. The wireless communication device of claim 10, wherein an acute angle is formed between the first radiating arm and the second radiating arm.

12. The wireless communication device of claim 10, wherein the second radiating portion comprises a third radiating arm and a fourth radiating arm that is connected to and coplanar with the third radiating arm; wherein the third radiating arm extends in a direction substantially perpendicular to the second feeding portion.

13. The wireless communication device of claim 12, wherein an acute angle is formed between the third radiating arm and the fourth radiating arm.

14. The wireless communication device of claim 12, wherein the second radiating arm is transversely across the fourth radiating arm.

15. The wireless communication device of claim 9, wherein the first antenna and the second antenna are monopole antennas.

16. The wireless communication device of claim 9, wherein the first feeding portion and the second feeding portion are substantially perpendicularly mounted on the printed circuit board.

17. An antenna structure comprising:

a printed circuit board;

a first antenna, the first antenna comprising a first radiating portion and a first feeding portion;

a second antenna, the second antenna comprising a second radiating portion and a second feeding portion; the second radiating portion positioned substantially parallel to the first radiating portion;

a radio frequency circuit, the radio frequency circuit positioned on the printed circuit board and electronically coupled to the first and second feeding portions, the radio frequency circuit configured to output a first current signal to the first feeding portion and a second current signal to the second feeding portion; and a controller, the controller positioned on the printed circuit board and electronically coupled to the radio frequency circuit, wherein the controller is configured to control the radio frequency circuit to adjust phases of the first and second current signals;

wherein the second feeding portion is longer than the first feeding portion, the first radiating portion is positioned between and spaced from the printed circuit board and the second radiating portion.

18. The antenna structure of claim 17, wherein first radiating portion comprises a first radiating arm and a second radiating arm connected to and coplanar with the first radiating arm; wherein the second radiating portion comprises a third radiating arm and a fourth radiating arm that is connected to and coplanar with the third radiating arm; and the second radiating arm is transversely across the fourth radiating arm.

* * * * *